United States Patent [19]

Ogawa et al.

[11] Patent Number: 4,476,218

[45] Date of Patent: Oct. 9, 1984

[54] SILVER HALIDE PHOTOGRAPHIC LIGHT-SENSITIVE MATERIALS

[75] Inventors: Masashi Ogawa; Kunio Ishigaki; Taku Nakamura; Nobuyuki Iwasaki, all of Kanagawa, Japan

[73] Assignee: Fuji Photo Film Co., Ltd., Kanagawa, Japan

[21] Appl. No.: 388,820

[22] Filed: Jun. 16, 1982

[30] Foreign Application Priority Data

Jun. 16, 1981 [JP] Japan ..... 56-92559

[51] Int. Cl.[3] ..... G03C 1/76; G03C 1/30

[52] U.S. Cl. ..... 430/539; 430/621; 430/622; 430/961

[58] Field of Search ..... 430/351, 355, 961, 621–626, 430/539

[56] References Cited

U.S. PATENT DOCUMENTS

| | | | |
|---|---|---|---|
| 3,782,955 | 1/1974 | Mucke et al. | 430/351 |
| 3,923,517 | 12/1975 | Yamamoto et al. | 430/621 |
| 4,021,248 | 5/1977 | Shiba et al. | 430/351 |
| 4,161,407 | 7/1979 | Campbell | 430/621 |
| 4,264,721 | 4/1981 | Shimano et al. | 430/351 |
| 4,267,265 | 5/1981 | Sugimoto et al. | 430/961 |
| 4,304,852 | 12/1981 | Sugimoto et al. | 430/961 |
| 4,366,238 | 12/1982 | Yokoyama et al. | 430/961 |

FOREIGN PATENT DOCUMENTS 1534455 11/1978 United Kingdom .

*Primary Examiner*—Mary F. Downey

*Attorney, Agent, or Firm*—Sughrue, Mion, Zinn, Macpeak and Seas

[57] ABSTRACT

A silver halide photographic light-sensitive material is described, which comprises a support, and at least one light-sensitive silver halide emulsion layer and an uppermost layer provided on at least one surface of the support, wherein the melting time of the uppermost layer is made greater than that of the light-sensitive silver halide emulsion layer. The material has good strength and produces a reduced amount of scum which normally occurs in the processing liquid during development processing.

12 Claims, No Drawings

SILVER HALIDE PHOTOGRAPHIC LIGHT-SENSITIVE MATERIALS

FIELD OF THE INVENTION

The present invention relates to silver halide photographic light-sensitive materials. More particularly, it is concerned with silver halide photographic light-sensitive materials which form less scum in processing liquids and can be rapidly processed at high temperatures.

BACKGROUND OF THE INVENTION

It has been greatly desired to shorten the time required for development of light-sensitive materials. In order to meet these requirements, the development time has been reduced by raising the development temperature to about 27° C. or higher. This is realized by the use of an automatic developing machine as described in, e.g., *Rodal Technol.*, Vol. 44, No. 4, pp. 257–261 (1973), U.S. Pat. Nos. 3,025,779 and 3,672,288 which permits rapid and highly reproducible development. Such automatic developing machines usually contain a developing tank, a stopping tank, a fixing tank, a water-washing tank, a drying zone, and so forth, and the speed of conveyance of films and the processing temperature can be controlled.

It is known, as described in Furnell et al., *J. Photo. Sci.*, Vol. 18, p. 94 (1970), that with photographic light-sensitive materials using a silver halide emulsion, when the degree of swelling of the material in a developer is changed by changing the degree of hardening of a binder, e.g., gelatin, the covering power based on developed silver can be increased. It has been observed that as the degree of hardening of a silver halide emulsion layer is decreased by reducing the amount of a hardener used, the covering power is further increased.

However, when the degree of hardening is lowered to great extent, the strength of the emulsion layer is seriously reduced, presenting various problems. For example, when processed in an automatic developing machine as described hereinbefore, the emulsion layer is liable to peel apart from the support, or it may be readily scratched during the handling. Furthermore, binders may come out of the light-sensitive materials into the processing liquids in the automatic developing machine. These binders may combine together with each other, or with different compounds from the light-sensitive material in the processing liquid, and form precipitates insoluble in the processing liquid. These insoluble precipitates in the processing liquids are generally called "scum" in the art.

When scum is formed in a processing liquid, it sticks to a light-sensitive material which later passes through the automatic developing machine, causing contamination of the light-sensitive material. The scum sticking to the light-sensitive material seriously deteriorates the image quality of the light-sensitive material, as a result of which the product value is completely lost.

In order to overcome such problems, it is necessary to increase the degree of hardening of a silver halide emulsion layer to some extent. However, this inevitably leads to a reduction in the covering power. Although a number of methods for hardening silver halide emulsion layers are known, none of these methods make it possible to increase covering power without causing the formation of scum in processing liquids.

As a result of extensive studies to solve the above-described problems, it has been found that by controlling the degree of hardening of the uppermost layer independently from those of other underlying layers, i.e., by making the former greater than the latter, the elution of gelatin can be prevented. Accordingly, the formation of scum can be greatly reduced. Although it is well known that unreacted gelatin which has not been cross-linked by a hardener comes out from a light-sensitive material, and that the amount of the unreacted gelatin depends on the degree of hardening, it has been found for the first time according to the present invention that when the degree of hardening of the uppermost layer is increased, even if the degrees of hardening of underlying layers are small, i.e., the proportion of cross-linked gelatin in each of the underlying layers is small, the amount of gelatin eluted can be greatly reduced compared with conventional light-sensitive materials in which the degree of hardening of gelatin is the same in all coating layers. Furthermore, astonishingly, it has been found that the amount of gelatin eluted is based almost totally on the degree of hardening of the uppermost layer and is less affected by the degrees of hardening of the other underlying layers. This indicates that the cross-linking of the uppermost layer produces synergistic effects in the prevention of elution of gelatin. These synergistic effects could not have been anticipated by prior art teachings.

SUMMARY OF THE INVENTION

The object of the invention is to provide silver halide photographic light-sensitive materials which have a high covering power and when processed in an automatic developing machine, do not produce any scum in processing liquids in the automatic developing machine.

The present invention, therefore, relates to a siler halide photographic light-sensitive material comprising a support with at least one light-sensitive silver halide emulsion layer and the uppermost layer on at least one side thereof wherein the "melting time" of the uppermost layer is greater than that of the light-sensitive silver halide emulsion layer. The melting time (MT) is discussed further below and relates to the time required for a hardened layer to melt when it is soaked in a solution maintained at a certain temperature.

DETAILED DESCRIPTION OF THE INVENTION

As is known in the art, the degree of hardening can be controlled from layer to layer by the use of non-diffusable hardeners. As such non-diffusible hardeners, various polymeric hardeners which have molecular weight of more than about 10,000 and at least one functional group reactive to gelatin to form cross-linking can be used in the silver halide photographic light-sensitive materials of the present invention. These hardeners include those as described in, for example, U.S. Pat. Nos. 3,057,723, 3,396,029, 4,161,407, British Pat. No. 2,064,800 and U.S. application Ser. No. 251,827. One preferred example of the polymeric hardener is that described in U.S. application Ser. No. 251,827, which has a repeating unit represented by the following formula (I):

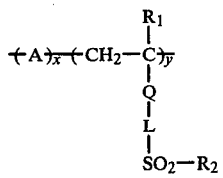

(I)

wherein A is a monomer unit prepared by copolymerizing copolymerizable ethylenically unsaturated monomers; $R_1$ is hydrogen or a lower alkyl group having 1 to 6 carbon atoms; Q is $—CO_2—$,

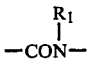

(wherein $R_1$ is the same as defined above) or an arylene group having 6 to 10 carbon atoms; L is a divalent group having 3 to 15 carbon atoms and containing at least one linking group selected from the members consisting of $—CO_2—$ and

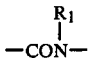

(wherein $R_1$ is the same as defined above) or a divalent group having 1 to 12 carbon atoms and containing at least one linking group selected from the members consisting of —O—,

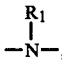

—CO—, —SO—, $—SO_2—$, $—SO_3—$,

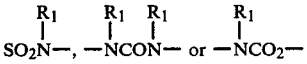

(wherein $R_1$ is the same as defined above); $R_2$ is $—CH{=}CH_2$ or $—CH_2CH_2X$ (wherein X is a group capable of being substituted with a nucleophilic group or a group capable of being released in the form of HX upon a base; and x and y each represents molar percent, x being between 0 and 99 and y being between 1 and 100.

Examples of ethylenically unsaturated monomers represented by "A" of formula (I) include ethylene, propylene, 1-butene, isobutene, styrene, chloromethylstyrene, hydroxymethylstyrene, sodium vinylbenzenesulfonate, sodium vinylbenzylsulfonate, N,N,N-trimethyl-N-vinylbenzylammonium chloride, N,N-dimethyl-N-benzyl-N-vinylbenzylammonium chloride, α-methylstyrene, vinyltoluene, 4-vinylpyridine, 2-vinylpyridine, benzyl vinylpyridinium chloride, N-vinylacetamide, N-vinylpyrrolidone, 1-vinyl-2-methylimidazole, monoethylenically unsaturated esters of aliphatic acids (e.g., vinyl acetate and allyl acetate), ethylenically unsaturated mono- or dicarboxylic acids and salts thereof (e.g., acrylic acid, methacrylic acid, itaconic acid, maleic acid, sodium acrylate, potassium acrylate and sodium methacrylate), maleic anhydride, esters of ethylenically unsaturated monocarboxylic or dicarboxylic acids (e.g., n-butyl acrylate, n-hexyl acrylate, hydroxyethyl acrylate, cyanoethyl acrylate, N,N-diethylaminoethyl acrylate, methyl methacrylate, n-butyl methacrylate, benzyl methacrylate, hydroxyethyl methacrylate, chloroethyl methacrylate, methoxyethyl methacrylate, N,N-diethylaminoethyl methacrylate, N,N,N-triethyl-N-methacryloyloxyethylammonium-p-toluene sulfonate, N,N-diethyl-N-methyl-N-methacryloyloxyethylammonium-p-toluene sulfonate, dimethyl itaconate and monobenzyl maleate), and amides of ethylenically unsaturated monocarboxylic or dicarboxylic acids (e.g., acrylamide, N,N-dimethylacrylamide, N-methylolacrylamide, N-(N,N-dimethylaminopropyl)acrylamide, N,N,N-trimethyl-N-(N-acryloylpropyl)ammonium-p-toluene sulfonate, sodium 2-acrylamide-2-methylpropane sulfonate, acryloyl morpholine, methacrylamide, N,N-dimethyl-N'-acryloyl propane diamine propionate betaine, and N,N-dimethyl-N'-methacryloyl propane diamine acetate betaine). "A" further includes monomers having at least two copolymerizable ethylenically unsaturated groups (e.g., divinylbenzene, methylenebisacrylamide, ethylene glycol diacrylate, trimethylene glycol diacrylate, ethylene glycol dimethacrylate, trimethylene glycol dimethacrylate and neopentyl glycol dimethacrylate).

Examples of $R_1$ of formula (I) include a methyl group, an ethyl group, a butyl group and an n-hexyl group.

Examples of Q of formula (I) include the following groups: $—CO_2—$, —CONH—,

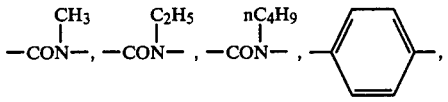

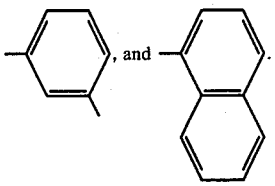

Examples of L of formula (I) include the following groups: $—CH_2CO_2CH_2—$, $—CH_2CO_2CH_2CH_2—$, $—CH_2CH_2CO_2CH_2CH_2—$, $—(CH_2)_5CO_2CH_2CH_2—$, $—(CH_2)_{10}CO_2CH_2CH_2—$, $—CH_2NHCOCH_2—$, $—CH_2NHCOCH_2CH_2—$, $—(CH_2)_3NHCOCH_2CH_2—$, $—(CH_2)_5NHCOCH_2CH_2—$, $—(CH_2)_{10}NHCOCH_2CH_2—$, $—CH_2OCH_2—$, $—CH_2CH_2OCH_2CH_2CH_2—$,

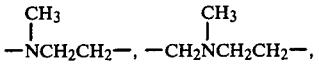

$—COCH_2CH_2—$, $—CH_2COCH_2CH_2—$,

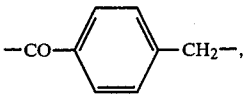

$—SOCH_2CH_2—$, $—CH_2SOCH_2CH_2—$, $—SO_2CH_2CH_2—$, $—SO_2CH_2CH_2SO_2CH_2CH_2—$, $$-SO_2CH_2CH_2SO_2CH_2\underset{\underset{OH}{|}}{C}HCH_2-,$$

$-SO_3CH_2CH_2CH_2-$, $-SO_3CH_2CO_2CH_2CH_2-$, $-SO_3CH_2CH_2CO_2CH_2CH_2-$, $-SO_2NHCH_2CO_2CH_2CH_2-$, $-SO_2NHCH_2CH_2CO_2CH_2CH_2-$, $-NHCONHCH_2CH_2-$, $-CH_2NHCONHCH_2CH_2-$, $-NHCO_2CH_2CH_2-$, $-CH_2NHCO_2CH_2CH_2-$.

Examples of $R_2$ of formula (I) include the following groups: $-CH{=}CH_2$, $-CH_2CH_2Cl$, $-CH_2CH_2Br$, $-CH_2CH_2O_3SCH_3$,

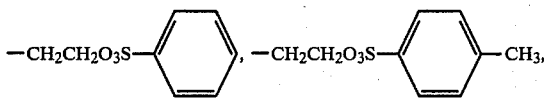

$-CH_2CH_2OH$, $-CH_2CH_2O_2CCH_3$, $-CH_2CH_2O_2CCF_3$ and $-CH_2CH_2O_2CCHCl_2$.

Another preferred example of the polymeric hardener is that described in U.S. Pat. No. 4,161,407, which has a repeating unit represented by the following formula (II):

$$\left(A\right)_x\left(CH_2-\underset{\underset{CH_2SR'}{|}}{\overset{\overset{O}{\|}}{\underset{\underset{L}{|}}{C}}}R\right)_y \qquad \text{(II)}$$

wherein A is a polymerized $\alpha,\beta$-ethylenically unsaturated addition polymerizable monomer or a mixture of such polymerizable monomers; x and y are the molar percentages of the resulting units in the polymer and are whole integers, x being from 10 to about 95 percent and y being 5 to 90 percent; R is hydrogen or an alkyl group having 1 to 6 carbon atoms; R′ is $-CH{=}CHR_2$ or $-CH_2CH_2X$ where X is a leaving group which is displaced by a nucleophile or eliminated in the form of HX by treatment with base; $R_2$ is alkyl, aryl or hydrogen; -L- is a linking group selected from the group consisting of alkylene, preferably containing about 1 to 6 carbon atoms, such as methylene, ethylene, isobutylene and the like; arylene of about 6 to 12 nuclear carbon atoms, such as phenylene, tolylene, naphthalene and the like; —COZ— or $-COZR_3-$; $R_3$ is alkylene, preferably of 1 to 6 carbon atoms, or arylene, preferably of 6 to 12 carbon atoms; and Z is O or NH.

Examples of A of formula (II) include the same examples of A of formula (I), examples of R of formula (II) include the same examples of $R_1$ of formula (I) and examples oF R′ of formula (II) include the same examples of $R_2$ of formula (I), all of which are described above.

Still another preferred example of the polymeric hardener is that described in British Pat. No. 1,534,455, which has a repeating unit represented by the following formula (III):

$$\left(A\right)_x\left(CH_2-\underset{\underset{X}{|}}{\underset{\underset{(L)_m}{|}}{\overset{\overset{R}{|}}{C}}}\right)_y \qquad \text{(III)}$$

wherein A is a monomer unit copolymerized with a copolymerizable ethylenically unsaturated monomer; R is a hydrogen atom or an alkyl group having 1 to 6 carbon atoms; L is a divalent linking group having 1 to 20 carbon atoms; X is an active ester group; x and y each represents molar percent, with x being between 0 and 95 and y being between 5 and 100 and m is 0 or 1.

Examples of A of formula (III) include the same examples of A of formula (I) and examples of R of formula (III) include the same examples of $R_1$ of formula (I), both of which are described above.

Examples of L of formula (III) include the following: $-CONHCH_2-$, $-CONHCH_2CH_2-$, $-CONHCH_2CH_2CH_2-$, $-CONHCH_2CH_2CH_2CH_2CH_2-$, $-CO_2CH_2CH_2OCOCH_2CH_2-$, $-CONHCH_2CONHCH_2-$, $-CONHCH_2CONHCH_2CONHCH_2-$, $-CO_2CH_2-$, $-CONHCH_2NHCOCH_2CH_2SCH_2CH_2-$, $-CONHCH_2OCOCH_2CH_2-$.

Examples of X of formula (III) include the following:

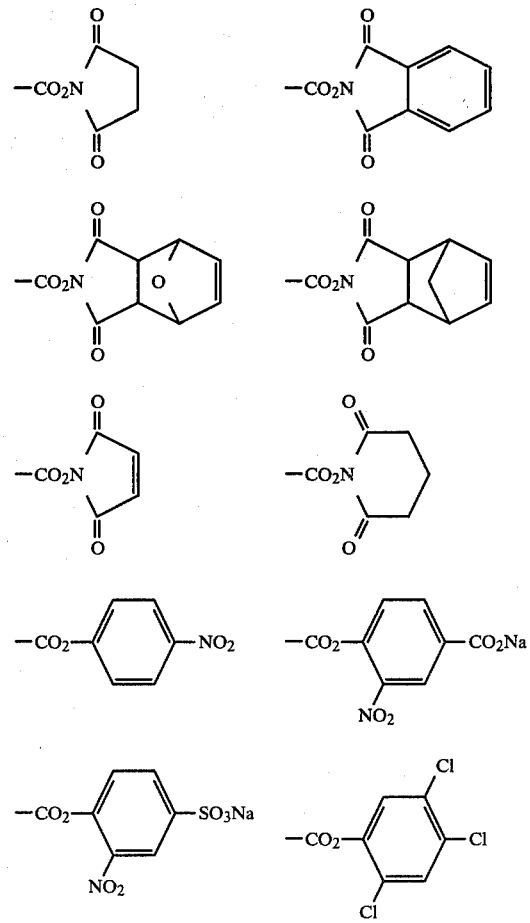

-continued

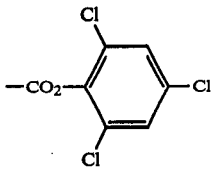

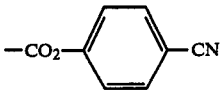

$-CO_2CH_2CN$ $-CO_2CH_2CO_2C_2H_5$ $-CO_2CH_2CONH_2$ $-CO_2CH_2COCH_3$ $-CO_2CH_2CO_2CH{=}CH_2$

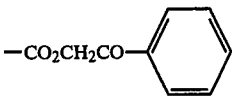

$-CO_2N{=}CHCH_3$ $-CO_2N{=}C(CH_3)_2$

-continued $-CO_2C(CH_3){=}CHCOCH_3$

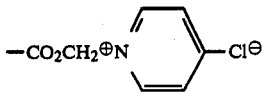

$-CO_2CH_2CH_2Br$ $-CO_2CH_2CH_2CN$ $-CO_2CH_2CH_2\overset{CH_3}{\underset{CH_3}{\overset{|}{\underset{|}{\oplus N}}}}-CH_3Cl^{\ominus}$ Among the above preferred examples of the polymeric hardeners, the polymeric hardener having repeating unit of formula (I) is particularly preferred.

Typical examples of the polmeric hardener are shown below as P-1 to P-22. Among them, P-1, 2, 6 and 19 are particularly preferred.

P-1 $\left(CH_2CH\right)_x$ $CONHC(CH_3)_2CH_2SO_3Na$ $\left(CH_2CH\right)_y$ $COOCH_2CH_2OCOCH_2SO_2CH{=}CH_2$ x/y = 3/1

P-2 $\left(CH_2CH\right)_x$ $CONHC(CH_3)_2CH_2SO_3Na$ $\left(CH_2CH\right)_y$ $CONHCH_2NHCOCH_2CH_2SO_2CH{=}CH_2$ x/y = 3/1

P-3 $\left(CH_2CH\right)_x$ $CONHC(CH_3)_2CH_2SO_3Na$ $\left(CH_2CH\right)_y$ $CONHCH_2CH_2CH_2NHCOCH_2CH_2SO_2CH{=}CH_2$ x/y = 3/1

P-4 $\left(CH_2CH\right)_x$ $CONHC(CH_3)_2CH_2SO_3Na$ $\left(CH_2CH\right)_y$

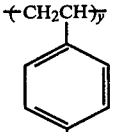

$SO_2CH_2CH_2SO_2CH{=}CH_2$ x/y = 3/1

P-5 $\left(CH_2CH\right)_x$ $CONHC(CH_3)_2CH_2SO_3Na$ $\left(CH_2CH\right)_y$

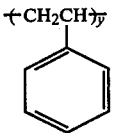

$SO_2CH_2CH_2SO_2CH_2CH(OH)CH_2SO_2CH{=}CH_2$ x/y = 3/1

P-6 $\left(CH_2CH\right)_x$ $CONHC(CH_3)_2CH_2SO_3Na$ $\left(CH_2CH\right)_y$

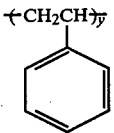

$CH_2NHCOCH_2CH_2SO_2CH{=}CH_2$ x/y = 3/1

P-7 $\left(CH_2CH\right)_x$ $CONHC(CH_3)_2CH_2SO_3Na$ $\left(CH_2CH\right)_y$ $NHCONHCH_2SO_2CH{=}CH_2$ x/y = 3/1

-continued

P-8 $\left(CH_2CH\right)_x$ | $CONHC(CH_3)_2CH_2SO_3Na$ $\left(CH_2CH\right)_y$ | $CONHCOCH_2CH_2SO_2CH{=}CH_2$ x/y = 3/1

P-9 $\left(CH_2CH\right)_x$ | $CONHC(CH_3)_2CH_2SO_3Na$ $\left(CH_2CH\right)_y$ | $COOCH_2CH_2OCOCH_2SO_2CH_2CH_2Cl$ x/y = 3/1

P-10 $\left(CH_2CH\right)_x$ | $CONHC(CH_3)_2CH_2SO_3Na$ $\left(CH_2CH\right)_y$ | $CONHCH_2NHCOCH_2CH_2SO_2CH_2CH_2Cl$ x/y = 3/1

P-11 $\left(CH_2CH\right)_x$ | $CONHC(CH_3)_2CH_2SO_3Na$ $\left(CH_2CH\right)_y$ | $CONHCH_2NHCOCH_2CH_2SO_2CH_2CH_2Br$ x/y = 3/1

P-12 $\left(CH_2CH\right)_x$ | $CONHC(CH_3)_2CH_2SO_3Na$

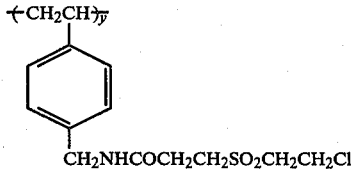

x/y = 3/1

P-13 $\left(CH_2CH\right)_x$ | $CONHC(CH_3)_2CH_2SO_3Na$

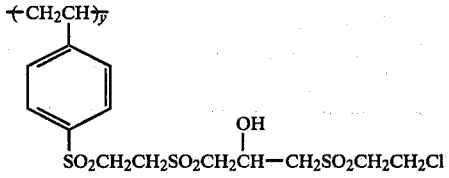

x/y = 3/1

P-14 $\left(CH_2CH\right)_x$ | $CONHC(CH_3)_2CH_2SO_3Na$ $\left(CH_2CH\right)_y$ | $CONHCOCH_2CH_2SO_2CH_2CH_2Cl$ x/y = 3/1

P-15 $\left(CH_2CH\right)_x$ | $COOM$ $\left(CH_2CH\right)_y$ | $CONHCH_2COCH_2CH_2SO_2CH_2CH_2Cl$ x/y = 3/1

P-16 $\left(CH_2CH\right)_x$ | $COOM$ $\left(CH_2CH\right)_y$ | $CONHCH_2NHCOCH_2CH_2SO_2CH{=}CH_2$ x/y = 3/1

P-17 $\left(CH_2CH\right)_x$ | $COOM$

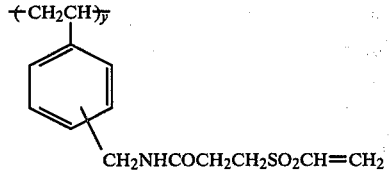

x/y = 3/1

-continued

| | | |
|---|---|---|
| P-18 | $\leftarrow CH_2CH \rightarrow_x$ (COOM) | $\leftarrow CH_2CH \rightarrow_y$ 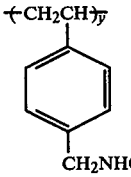 $CH_2NHCOCH_2CH_2SO_2CH_2CH_2Cl$ x/y = 3/1 |
| P-19 | $\leftarrow CH_2CH \rightarrow_x$ (COOM) | $\leftarrow CH_2CH \rightarrow_y$ 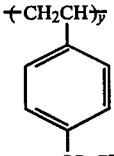 $SO_2CH_2CH_2SO_2CH_2\overset{OH}{\overset{\vert}{C}}HCH_2SO_2CH{=}CH_2$ x/y = 3/1 |
| P-20 | $\leftarrow CH_2CH \rightarrow_x$ (COOM) | $\leftarrow CH_2CH \rightarrow_y$ 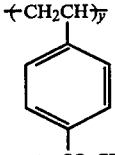 $SO_2CH_2CH_2SO_2CH_2\overset{OH}{\overset{\vert}{C}}HCH_2SO_2CH_2CH_2Cl$ x/y = 3/1 |
| P-21 | $\leftarrow CH_2CH \rightarrow_x$ (COOM) | $\leftarrow CH_2CH \rightarrow_y$ $COOCH_2CH_2OCOCH_2SO_2CH{=}CH_2$ x/y = 3/1 |
| P-22 | $\leftarrow CH_2CH \rightarrow_x$ (COOM) | $\leftarrow CH_2CH \rightarrow_y$ $COOCH_2CH_2OCOCH_2SO_2CH_2{-}CH_2Cl$ x/y = 3/1 |

In the above formulae, M is a hydrogen atom, a sodium atom or a potassium atom, and x and y represent the molar percent of the corresponding units charged. The molar percent is not limited to those specified in the above formulae, x may be from 0 to 99, and y, from 1 to 100.

Usually, the polymeric hardener of the present invention is used in an amount such that it contains from $0.1\times10^{-3}$ to $30\times10^{-3}$ equivalent of functional group reactive to gelatin per 100 g of gelatin. A particularly preferable range is from $0.5\times10^{-3}$ to $10\times10^{-3}$ equivalent per 100 g of gelatin.

Methods of synthesizing typical ethylenically unsaturated monomers containing a vinyl sulfone group or its precursor which are used in the preparation of polymeric hardeners for use in the invention will hereinafter be described.

PREPARATION EXAMPLE 1

Synthesis of 2-[3-(Chloroethylsulfonyl)propionyloxy]ethyl Acrylate

A mixture of 600 ml of tetrahydrofuran, 45.8 g of hydroxyethyl acrylate, and 72 g of 3-(2-chloroethylsulfonyl)propionic acid chloride was placed in a reactor, and while maintaining the temperature at 5° C. or lower by cooling by ice water, a solution of 31.2 g of pyridine in 100 ml of tetrahydrofuran was added dropwise thereto over a period of 1.75 hours. The resulting mixture was further stirred for 2 hours at room temperature. At the end of the time, the reaction mixture was poured into 2,500 ml of ice water, and extraction was performed four times with 300 ml of chloroform. The organic layer thus extracted was dried over sodium sulfate and concentrated to provide 87 g of 2-[3-(chloroethylsulfonyl)propionyloxy]ethyl acrylate. Yield was 88%.

PREPARATION EXAMPLE 2

Synthesis of [3-(Chloroethylsulfonyl)propionyl]aminomethylstyrene

A mixture of 100 ml of tetrahydrofuran, 20.1 g of vinylbenzylamine, 16.7 g of triethylamine, and 0.1 g of hydroquinone was placed in a reactor, and while cooling with ice water, a solution of 36.1 g of β-chloroethylsulfonylpropionic acid chloride in 200 ml of tetrahydrofuran was added dropwise thereto over a period of 30 minutes. The resulting mixture was allowed to stand overnight at room temperature. The reaction mixture was then poured into a solution prepared by diluting 16.5 g of concentrated hydrochloric acid with 1,500 ml of ice water, and a precipitate was filtered off. The precipitate was recrystallized from a mixed solvent of 200 ml of ethanol and 200 ml of water to provide 26.8 g of N-vinylbenzyl-β-chloroethylsulfonyl propionic acid amide. Yield was 57%. Elemental analysis (found): H, 5.74; C, 53.47; N, 4.83; Cl, 10.99; S, 10.49.

PREPARATION EXAMPLE 3

Synthesis of
1-{[2-(4-Vinylbenzenesulfonyl)ethyl]sulfonyl}-3-chloroethylsulfonyl-2-propanol A mixture of 157 g of 1,3-bischloroethylsulfonyl-2-propanol (prepared by the method disclosed in British Pat. No. 1,534,455), 1,000 ml of methanol, and 1,000 ml of distilled water was placed in a reactor, and while maintaining the temperature at 46° C., a solution prepared by dissolving 52 g of potassium vinylbenzenesulfinate in 100 ml of methanol and 100 ml of distilled water was added dropwise thereto over a period of 1 hour. The resulting mixture was further stirred for 5.5 hours while maintaining at 46° C. The precipitate thus formed was filtered off to obtain 55 g of 2-(1-vinylbenzenesulfonyl)ethylsulfonyl-3-chloroethylsulfonyl-2-propanol. Yield was 49%. Elemental analysis (found): H, 4.67; C, 39.89; S, 21.43.

PREPARATION EXAMPLE 4

Synthesis of
N-{[3-(Vinylsulfonyl)propionyl]aminomethyl}-acrylamide

In a 2,000 ml reactor were introduced 1,400 ml of distilled water, 224 g of sodium sulfite, and 220 g of sodium hydrogencarbonate, which were then stirred to form a uniform solution. Then, while maintaining the temperature of about 5° C. by cooling with ice water, 260 g of chloroethanesulfonyl chloride was added dropwise thereto over a period of 1.5 hours. After the dropwise addition was completed, 160 g of 49% sulfuric acid was added dropwise thereto over a period of about 15 minutes, and the resulting mixture was stirred for 1 hour at 5° C. Crystals precipitated were collected by filtration and washed with 400 ml of distilled water. The filtrate and the washing liquid were combined together and placed in a 3,000 ml reactor. Into the reactor was introduced dropwise a solution of 246 g of methylenebisacrylamide in 480 ml of distilled water and 1,480 ml of ethanol while maintaining the temperature at about 5° C. over a period of 30 minutes. The reactor was then placed in a refrigerator and was allowed to stand for 5 days to complete the reaction. Crystals precipitated were collected by filtration and, thereafter, they were washed with 800 ml of distilled water and recrystallized from 2,000 l of a 50% aqueous solution of ethanol to obtain 219 g of the desired monomer. Yield was 49%.

In addition, methods of synthesizing polymeric hardeners which are preferably used in the present invention will hereinafter be described.

PREPARATION EXAMPLE 5

Synthesis of 2-[3-(Vinylsulfonyl)propionyloxy]ethyl Acrylate/Sodium Acrylamido-2-methylpropanesulfonate Copolymer (P-1)

A mixture of 60 ml of N,N-dimethylformamide, 14.5 g of 2-[3-(chloroethylsulfonyl)propioyloxy]ethyl acrylate, and 23.5 g of acrylamido-2-methylpropanesulfonic acid was placed in a reactor. After purging with nitrogen gas, the mixture was heated to 60° C., and 0.40 g of 2,2'-azobis(2,4-dimethylvaleronitrile) was added thereto. The resulting mixture was stirred for 2 hours while heating at that temperature. Subsequently, 0.2 g of 2,2'-azobis(2,4-dimethylvaleronitrile) was added, and the mixture was stirred for 2 hours while heating. At the end of the time, the mixture was cooled down to 5° C., and 12 g of sodium carbonate and 4.9 g of triethylamine were added. The resulting mixture was stirred for 1 hour and additionally for 1 hour at room temperature. The reaction mixture was placed in a tube of cellulose and was subjected to dialysis for 2 days. The product was freeze-dried to obtain 35 g of a white polymer. Yield was 95%. The vinylsulfone content of the polymer thus formed was $0.51\times10^{-3}$ equivalent/g.

PREPARATION EXAMPLE 6

Synthesis of
[3-(Chloroethylsulfonyl)propionyl]aminomethylstyrene/Sodium Acrylamido-2-methylpropanesulfonate Copolymer (P-6)

A mixture of 15.8 g of [3-(Vinylsulfonyl)propionyl]aminomethylstyrene, 23.6 g of sodium acrylamido-2-methylpropanesulfonate, and 75 ml of N,N-dimethylformamide was placed in a reactor. After purging with nitrogen gas, the mixture was heated to 80° C., and 0.75 g of 2,2'-azobis(2,4-dimethylvaleronitrile) was added thereto. The resulting mixture was stirred for 3 hours while heating. Then, 25 ml of N,N-dimethylformamide was added, and subsequently 6.1 g of triethylamine was added dropwise at room temperature. The resulting mixture was stirred for 1 hour at room temperature. At the end of the time, the reaction mixture was filtered. The filtrate thus obtained was poured into 800 ml of acetone, and the thus-formed precipitate was filtered off and dried to obtain 36.2 g of pale yellow polymer. Yield was 94%. The vinylsulfone content of the polymer was $0.80\times10^{-3}$ equivalent/g.

PREPARATION EXAMPLE 7

Synthesis of
1-{[2-(4-Vinylbenzenesulfonyl)ethyl]sulfonyl}-3-chloroethylsulfonyl-2-propanol/Sodium Acrylate Copolymer (P-19)

A mixture of 300 ml of N,N-dimethylformamide, 40.1 g of 2-(1-vinylbenzenesulfonyl)ethylsulfonyl-3-chloroethylsulfonyl-2-propanol, and 13.0 g of acrylic acid was placed in a reactor. After purging with nitrogen gas, the mixture was heated to 70° C., and 0.53 g of 2,2'-azobis(2,4-dimethylvaleronitrile) was added thereto. The resulting mixture was heated for 1.5 hours while stirring. Subsequently, 0.53 g of 2,2'-azobis(2,4-dimethylvaleronitrile) was added thereto, and the mixture was further heated for 1 hour while stirring. The reaction mixture was allowed to cool down to room temperature, and 54.8 g of a 28% methanol solution of sodium methylate was added dropwise thereto. Stirring was further continued for 1 hour. The reaction mixture was placed in a tube of cellulose and was subjected to dialysis for 2 days. The product was freeze-dried to obtain 30 g of pale yellow polymer. Yield was 56%. The vinylsulfone content of the polymer was $1.4\times10^{-3}$ equivalent/g.

PREPARATION EXAMPLE 8

Synthesis of Polymer (P-2)

A mixture of 5.65 g of the monomer prepared in Preparation Example 1, 9.16 g of sodium acrylamido-2-methylpropanesulfonate, and 80 ml of a 50% aqueous solution of ethanol was placed in a 200 ml reactor, and was heated to 80° C. while stirring. At this temperature, 0.1 g of 2,2'-azobis(2,4-dimethylvaleronitrile) (sold by Wako Pure Chemical Industries Ltd. under the trade name of V-65) was added and additionally, after 30 minutes, 0.1 g of the same compound as above was added. The mixture was heated for 1 hour while stirring. Thereafter, the reaction mixture was cooled down to about 10° C. with ice water, and a solution of 2.5 g of triethylamine in 80 ml of ethanol was added thereto. Stirring was further continued for 1 hour. At the end of the time, the reaction mixture was poured into 1,000 ml of acetone while stirring, and the thus-formed precipitate was filtered off to obtain 12.4 g of Polymer (P-2). Yield was 85%. The intrinsic viscosity, $[\eta]$, was 0.227, and the vinylsulfone content was $0.95\times10^{-3}$ equivalent/g.

In hardening emulsion layers, polymeric hardeners as described hereinbefore may be used either singly or in combination with diffusible low-molecular hardeners. Diffusible hardeners which can be used include various organic and inorganic hardeners which are used either singly or in combination with each other. Typical examples of such hardeners include aldehyde compounds, e.g., mucochloric acid, formaldehyde, trimethylolmelamine, glyoxal, 2,3-dihydroxy-1,4-dioxane, 2,3-dihydroxy-5-methyl-1,4-dioxane, succinaldehyde, and glutaraldehyde; active vinyl compounds, e.g., divinyl sulfone, methylenebismaleimide, 1,3,5-triacryloyl-hexahydro-s-triazine, 1,3,5-trivinylsulfonyl-hexahydro-s-triazine, bis(vinylsulfonylmethyl) ether, 1,3-bis(vinylsulfonyl)propanol-2, bis(α-vinylsulfonylacetoamido)-ethane, 1,2-bis(vinylsulfonyl)ethane, and 1,1'-bis(vinylsulfonyl)methane; active halogeno compounds, e.g., 2,4-dichloro-6-hydroxy-6-methoxy-s-triazine; and ethyleneimine compounds, e.g., 2,4,6-triethyleneimino-s-triazine. These compounds are well known in the art as hardeners for gelatin.

These polymeric hardeners are dissolved in water or organic solvents and, thereafter, are added directly to a layer in order to control the degree of hardening of that particular layer. In the case of diffusible hardeners, they may be added directly to the layer which is to be controlled in the degree of hardening, or alternatively they may be added to another layer and then diffused in the whole layer. The amount of the non-diffusible hardener added is determined by the amount of the reactive group in the polymeric hardener.

Non-diffusible hardeners may be used either singly or in combination with diffusible hardeners.

In accordance with another technique to control the degrees of hardening of coating layers, low molecular hardeners are employed. By controlling the method of addition and drying conditions, diffusion properties are controlled. For example, a low molecular weight hardener containing a vinylsulfone group is incorporated into only a coating solution for a surface protective layer and, after a plurality of layers are coated at the same time, the layers are rapidly dried whereby the degree of hardening can be changed from layer to layer.

Measures well known in the art for evaluation of the degree of hardening of a hardened layer include the degree of swelling as determined by swelling the hardening layer in a certain solution, and the scratching strength which is indicated by determining the load at which the hardened layer is scratched by a needle-like stylus under the load. However, in order to evaluate the prevention of scum (which is the primary purpose of the present invention), it is most effective to employ a melting time (MT). The melting time is the time required for a hardened layer to melt when it is soaked in a solution maintained at a cetain temperature. It is most preferred to measure the melting time in a 0.2N NaOH solution maintained at 60° C. although the present invention is not limited thereto.

Silver halide emulsions as used herein are ordinarily prepared by mixing water-soluble silver salt (e.g., silver nitrate) solutions and water-soluble halogenide (e.g., potassium bromide) solutions in the presence of water-soluble polymer (e.g., gelatin) solutions.

Silver halides which can be used include mixed silver halides, e.g., silver chlorobromide, silver iodobromide, and silver chloroiodobromide, as well as silver chloride, silver bromide, and silver iodide.

These silver halide grains can be prepared by the usual techniques. It is also useful to prepare them by the so-called single or double jet method, and control double jet method, and so forth.

Photographic emulsions are well known as described in, for example, Mees, *The Theory of Photographic Process,* Macmillan Corp., and P. Glafkides, *Chimie Photographique,* Paul Montel (1957), and can be prepared by various known techniques such as an ammonia method, a neutral method, and an acidic method.

Silver halide emulsions are usually subjected to chemical sensitization although so-called primitive emulsions not subjected to chemical sensitization may be used. Chemical sensitization can be achieved by the methods as described in the above-described reference by P. Glafkides, the book by Zelikman, and H. Frieser Ed., *Die Grundlagen der Photographischen Prozesse mit Silberhalogeniden,* Akademische Verlagsgesellschaft (1968).

A sulfur sensitization method in which compounds containing sulfur capable of reacting with a silver ion, and active gelatin are used, a reduction sensitization method in which reducing compounds are used, a noble metal sensitization method in which gold and other noble metal compounds are used, and so forth can be used either singly or in combination with each other.

Sulfur sensitizers which can be used include thiosulfates, thioureas, thiazoles, and rhodanines. These compounds are described in U.S. Pat. Nos. 1,574,944, 2,410,689, 2,278,947, 2,728,668, 3,656,955, 4,030,928 and 4,067,740. Reduction sensitizers which can be used include stannous salts, amines, hydrazine derivatives, formamidinesulfinic acid, and silane compounds. These compounds are described in U.S. Pat. Nos. 2,487,850, 2,419,974, 2,518,698, 2,983,609, 2,983,610, 2,694,637, 3,930,867 and 4,054,458. For noble metal sensitization, in addition to gold complex salts, complex salts of Group VIII metals, e.g., platinum, iridium, and palladium, of the Periodic Table can be used. These compounds are described in U.S. Pat. Nos. 2,399,083 and 2,448,060, and British Pat. No. 618,061.

Hydrophilic colloids which can be used in the present invention as binders for silver halide include high molecular weight gelatin, colloidal albumin, casein, cellulose derivatives, e.g., carboxymethyl cellulose, and hydroxyethyl cellulose, sugar derivatives, e.g., agar, sodium alginate, and starch derivatives, and synthetic hydrophilic colloids, e.g., polyvinyl alcohol, poly-N-vinylpyrrolidone, polyacrylic acid copolymers, and polyacrylamide, or their derivatives or partially hydrolyzed products. If necessary, mixtures comprising two or more mutually soluble colloids of the above-described compounds may be used. Of the above-described compounds, gelatin is most commonly used.

Part or the whole of gelatin may be displaced by a synthetic polymeric substance. In addition, it may be displaced by a graft polymer prepared by bonding molecular chains of other polymeric substances. Furthermore, gelatin derivatives prepared by treating the usual high molecular weight gelatin with reagents containing a group capable of reacting with an amino group, an imino group, a hydroxy group, or a carboxy group contained in the gelatin may be used partially.

Various compounds may be incorporated into the photographic emulsions used herein for the purpose of preventing the formation of fog during the production of light-sensitive materials or the storage thereof, or of stabilizing photographic performance. Compounds which can be used for that purpose include azoles, e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (especially, 1-phynyl-5-mercaptotetrazole); mercaptopyrimidines; mercaptotriazines; thioketo compounds. e.g., oxazolinethion; azaindenes, e.g., triazaindenes, tetraazaindenes (especially, 4-hydroxy-substituted (1,3,3a,7)tetraazaindenes), and pentaazaindenes; and benzenethiosulfonic acid, benzenesulfinic acid, and benzenesulfonic acid amide, which are known as anti-foggants or stabilizers.

Photographic emulsion layers and other hydrophilic colloid layers in the light-sensitive materials of the present invention may contain various known surfactants as coating aids or for various purposes of prevention of charging, improvement of sliding properties, emulsification and dispersion, prevention of adhesion, and improvement of photographic characteristics (e.g., acceleration of development, high contrast, and sensitization).

Photographic emulsions as used herein may be subjected to spectral sensitization using methine dyes, etc. Dyes which can be used include cyanine dyes, merocyanine dyes, composite cyanine dyes, composite merocyanine dyes, holopolar cyanine dyes, hemicyanine dyes, styryl dyes, and hemioxonol dyes.

Photographic emulsion layers or their adjacent layers in the photographic light-sensitive materials of the present invention may contain, for the purpose of increasing sensitivity, increasing contrast, or for accelerating development, polyalkyleneoxide or its ether, ester, amine or like derivatives, thioether compounds, thiomorpholines, quaternary ammonium chloride compounds, urethane derivatives, urea derivatives, imidazole derivatives, 3-pyrazolidones, and the like.

There are no limitations on surfactants, chemical sensitizers, silver halide, stabilizers, anti-foggants, antistatic agents, matting agents, spectral sensitizing dyes, dyes, color couplers, supports, and so forth, which are used in the silver halide emulsion layers and other hydrophilic colloid layers of the present invention. These additives are described in, for example, *Research Disclosure,* Vol. 176, pp. 22–31 (Dec. 1978) and Japanese Patent Application (OPI) No. 99928/78 (the term "OPI" as used herein refers to a "published unexamined Japanese patent application").

The light-sensitive material of the present invention is characterized in that the uppermost layer lying on a silver halide emulsion layer has a melting time longer than that of the silver halide emulsion layer.

The relation between the melting time of the uppermost layer (MTu) and that of the light-sensitive silver halide emulsion layer (MTs) employed in the present invention can be represented by MTu/MTs ratio. The ratio is usually in a range of more than 1 and less than 20, preferably more than 1 and less than 10, and most preferably more than 3 and less than 6.

The silver halide light-sensitive photographic materials of the present invention may include those having at least one of the light-sensitive silver halide emulsion layer on both sides of the support and the uppermost layer on the outside of the outermost silver halide emulsion layer existed on both sides of the support.

The uppermost layer existed in the silver halide light-sensitive photographic material of the present invention has a thickness of from about 0.5 to about 2.0 microns.

If necessary, a gelatin overcoat layer may be provided on the uppermost layer. It is preferred for such overcoat layers to have melting times shorter than that of the emulsion layer and to be as thin as possible. The gelatin overcoat layer described above should have a thickness of less than 0.5 microns.

A method of exposure of the light-sensitive material of the invention is not critical, and the exposure time may be either as long as from 1 second to several minutes or as short as from $10^{-6}$ to $10^{-3}$ second.

Preferred examples of automatic developing machines which can be used in the development of the light-sensitive material of the present invention include a roller conveyor type automatic developing machine, a belt conveyor type automatic developing machine, and a hanger type automatic developing machine. The development process temperature is preferably from 20° to 60° C. and more preferably from 27° to 45° C., and the development time is preferably from 10 seconds to 10 minutes and more preferably from 20 seconds to 5 minutes. Development processing steps, the composition of processing liquids, and so forth may be chosen referring to the above-described references and also to C. E. K. Mees & T. H. James, *The Theory of Photographic Processes,* 3rd Ed., Chapter 13, Macmillan Co. (1966) and L. F. A. Mason, *Photographic Processing Chemistry,* pp. 16–30, Oxford Press (1966).

The following examples are given to illustrate the invention in greater detail.

EXAMPLE 1

On both surfaces of an about 175μ thick polyethylene terephthalate film support which had been coated with a subbing layer on both surfaces were coated an emulsion layer and a protective layer having the formulations as shown below in that sequence to prepare Samples 1 to 8.

In Samples 1 to 8, a hardener as shown in Table 1 was added to each layer.

Emulsion Layer

Binder: 2.0 g/m$^2$ Gelatin

Amount of Silver Halide: 3.91 g/m$^2$

Composition of Silver Halide: 2.0 mol% AgI+98.0 mol% AgBr

Anti-Foggant: 0.5 g/Ag 100 g 1-Phenyl-5-mercaptotetrazole and 0.8 g/Ag 100 g 4-hydroxy(1,3,3a,7)tetraazaindene Protective Layer Binder: 1.3 g/m$^2$ Gelatin Coating Aid: 7 mg/m$^2$ N-Oleoyl-N-methyltaurine sodium salt Matting Agent: 25 mg/m$^2$ Polymethyl methacrylate (mean grain size: 5$\mu$)

TABLE 1

| Sample No. | Type and Amount of Gelatin Hardener Added to Protective Layer | |
|---|---|---|
| 1 (Comparison) | H-1 (0.5 mmol/gelatin* 100 g) | — |
| 2 (Comparison) | H-1 (0.75 mmol/gelatin* 100 g) | — |
| 3 (Comparison) | H-1 (1.50 mmol/gelatin* 100 g) | — |
| 4 (The present invention) | H-1 (0.5 mmol/gelatin* 100 g) | P-1 ($1.2 \times 10^{-3}$ eq./gelatin** 100 g) |
| 5 (The present invention) | H-1 (0.5 mmol/gelatin* 100 g) | P-1 ($2.0 \times 10^{-3}$ eq./gelatin** 100 g) |
| 6 (The present invention) | H-1 (0.5 mmol/gelatin* 100 g) | P-1 ($2.4 \times 10^{-3}$ eq./gelatin** 100 g) |
| 7 (The present invention) | H-1 (0.75 mmol/gelatin* 100 g) | P-1 ($0.7 \times 10^{-3}$ eq./gelatin** 100 g) |
| 8 (The present invention) | H-1 (0.75 mmol/gelatin* 100 g) | P-1 ($1.5 \times 10^{-3}$ eq./gelatin** 100 g) |

H-1 2-Hydroxy-4,6-dichloro-s-triazine sodium salt
*Amount of gelatin in all layers
**Amount of gelatin in the protective layer The degree of hardening of each layer was measured as follows:

Each sample was cut into a piece having a width of 0.5 cm and a length of 4 cm. This piece was soaked in an alkali solution (a 0.2N aqueous solution of sodium hydroxide) maintained at 60° C., and the melting time (MT) of each layer was measured.

The film strength was measured as follows:

Each sample was soaked in RD-III Developer as described hereinafter maintained at 35° C. for 25 seconds and, thereafter, a sapphire needle having a diameter of 0.8 mm was pressed to the film surface and moved at a rate of 5 mm/sec. By changing continuously the load on the sapphire needle, the load was determined at which the film was broken or scratches were formed. This load (grams) was used to indicate the film strength.

Samples 1 to 8 as prepared hereinbefore were exposed to light for 1/20 second by the use of the usual tungsten sensitometer and, thereafter, were developed with a developer at 32° C. for 40 seconds, fixed, and washed with water. With the thus-processed samples, the maximum density was measured.

The development processing liquid as used in the above development was a developer RD-III for a super-rapid processing Fuji X-ray automatic developing machine (produced by Fuji Photo Film Co., Ltd.). As a fixing liquid, a fixing solution Fuji F for an X-ray automatic developing machine (produced by Fuji Photo Film Co.) was used.

The results are shown in Table 2 below.

TABLE 2

| Sample No. | Melting Time (sec)* Protective Layer | Melting Time (sec)* Emulsion Layer | Film Strength (g) | Maximum Density |
|---|---|---|---|---|
| 1 (Comparison) | 8 | 8 | 35 | 3.18 |
| 2 (Comparison) | 43 | 43 | 45 | 2.78 |
| 3 (Comparison) | 278 | 278 | 87 | 2.06 |
| 4 (The present invention) | 280 | 10 | 35 | 3.18 |
| 5 (The present invention) | 351 | 9 | 36 | 3.10 |
| 6 (The present invention) | 393 | 13 | 37 | 3.02 |
| 7 (The present invention) | 257 | 39 | 47 | 2.82 |
| 8 (The present invention) | 364 | 47 | 48 | 2.78 |

*0.2 N NaOH, 60° C.

As can be seen from Table 2, in Samples 1 to 3, the melting time of the protective layer is equal to that of the emulsion layer, whereas, in Samples 4 to 8, the melting time of the protective layer is greater than that of the emulsion layer. The film strength corresponds to the melting time of the emulsion layer, and even if the melting time of the protective layer is increased, no great change in the film strength is observed. Within the film strength range of the samples, no practical problem arises. Furthermore, it can be seen that the maximum density is correlated with the melting time of the emulsion layer and can be controlled independently from the melting time of the protective layer.

In order to examine the formation of scum in a fixing solution, a small automatic developing machine produced by Fuji Photo Film Co., Ltd. (sold under the trade name of Fuji X-Ray Processor RE-3; capacity of developer: 2,000 ml; capacity of fixer: 2,000 ml) was used. After passage of 200 sheets having a width of 8.5 cm and a length of 30 cm, the turbidity in each processing liquid and the degree of contamination of the processed film were observed. The degree of contamination of the processed film (the degree of formation of scum) was indicated in the following four grades:

A: Until 200 sheets were all processed, no contamination was observed.

B: When 150 or more sheets were processed, slight contamination was observed.

C: When 100 or more sheets were processed, the formation of scum was somewhat observed.

D: When 25 or more sheets were processed, the considerable formation of scum was observed.

The degree of the turbidity in the processing liquid after processing 200 sheets was indicated in the following three grades:

xx: Considerable turbidity was observed.

x: Slight turbidity was observed.

o: No turbidity was observed.

In addition, the amount of gelatin eluted into the development processing liquid was measured by subjecting the liquid to molecular weight fractionation by means of gel chromatography (filler, Cephatic G-50). The amount of gelatin contained in 100 ml of the development processing liquid was indicated in terms of milligram.

The results are shown in Table 3.

TABLE 3

| Sample No. | Scum: Turbidity of Fixer | Scum: Contamination of Processed Film (degree of formation of scum) | Amount of Eluted Gelatin (mg, in 100 ml of developer) | Melting Time (0.2 N, NaOH, 60°0 C.) (sec): Protective Layer | Melting Time (0.2 N, NaOH, 60°0 C.) (sec): Emulsion Layer |
|---|---|---|---|---|---|
| 1 (Comparison) | xx | D | 290 | 8 | 8 |
| 2 (Comparison) | x | C–D | 185 | 43 | 43 |
| 3 (Comparison) | o | A–B | 110 | 278 | 278 |
| 4 (The present invention) | o | A–B | 112 | 280 | 10 |
| 5 (The present invention) | o | A | 90 | 351 | 9 |
| 6 (The present invention) | o | A | 85 | 393 | 13 |
| 7 (The present invention) | o | A–B | 115 | 257 | 39 |
| 8 (The present invention) | o | A | 91 | 364 | 47 |

It can be seen from Table 3 that even though the melting time of the emulsion layer is almost the same, as the melting time of the protective layer is increased, the amount of gelatin eluted is decreased and the formation of scum is greatly reduced and, thus, that the scum properties are greatly improved.

EXAMPLE 2

Samples 9 to 16 having the same construction as in Example 1 were prepared in which the type of hardener was changed and the hardener was added in the amount shown in Table 4. They were processed in the same manner as in Example 1, and the results are shown in Tables 5 and 6.

TABLE 4

| Sample No. | Type and Amount of Gelatin Hardener Added: Protective Layer | Type and Amount of Gelatin Hardener Added: Emulsion Layer |
|---|---|---|
| 9 | — | H-2* (0.5 mmol/gelatin** 100 g) |
| 10 | — | H-2 (0.75 mmol/gelatin** 100 g) |
| 11 | — | H-2 (1.50 mmol/gelatin** 100 g) |
| 12 (The present invention) | P-1 (1.2 × $10^{-3}$ eq./gelatin*** 100 g) | H-2 (0.5 mmol/gelatin** 100 g) |
| 13 (The present invention) | P-1 (2.0 × $10^{-3}$ eq./gelatin*** 100 g) | H-2 (0.5 mmol/gelatin** 100 g) |
| 14 (The present invention) | P-1 (2.4 × $10^{-3}$ eq./gelatin*** 100 g) | H-2 (0.5 mmol/gelatin** 100 g) |
| 15 (The present invention) | P-1 (0.7 × $10^{-3}$ eq./gelatin*** 100 g) | H-2 (0.75 mmol/gelatin** 100 g) |
| 16 (The present invention) | P-1 (1.5 × $10^{-3}$ eq./gelatin*** 100 g) | H-2 (0.75 mmol/gelatin** 100 g) |

*H-2: Bis(α-vinylsulfonylacetamido)ethane
**Amount of gelatin in all layers
***Amount of gelatin in the protective layer

TABLE 5

| Sample No. | Melting Time (0.2N NaOH, 60° C.) (sec): Protective Layer | Melting Time (0.2N NaOH, 60° C.) (sec): Emulsion Layer | Film Strength (g) | Maximum Density |
|---|---|---|---|---|
| 9 | 48 | 48 | 45 | 3.72 |
| 10 | 135 | 135 | 63 | 3.27 |
| 11 | 480 | 480 | 108 | 2.41 |
| 12 (The present invention) | 331 | 45 | 47 | 3.68 |
| 13 (The present invention) | 462 | 47 | 50 | 3.66 |
| 14 (The present invention) | 530 | 51 | 46 | 3.67 |
| 15 (The present invention) | 437 | 130 | 67 | 3.25 |
| 16 (The present invention) | 523 | 139 | 65 | 3.20 |

TABLE 6

| Sample No. | Scum: Turbidity of Fixer | Scum: Contamination of Processed Film | Amount of Eluted Gelatin (mg, in 100 ml of developer) | Melting Time (0.2 N NaOH, 60° C.) (sec): Protective Layer (sec) | Melting Time (0.2 N NaOH, 60° C.) (sec): Emulsion Layer (sec) |
|---|---|---|---|---|---|
| 9 | x | C–D | 193 | 48 | 48 |
| 10 | x | C | 133 | 135 | 135 |
| 11 | o | A | 82 | 480 | 480 |
| 12 (The present invention) | o | A–B | 96 | 331 | 45 |
| 13 (The present invention) | o | A | 82 | 462 | 47 |
| 14 (The present invention) | o | A | 78 | 530 | 51 |

TABLE 6-continued

| Sample No. | Scum: Turbidity of Fixer | Scum: Contamination of Processed Film | Amount of Eluted Gelatin (mg, in 100 ml of developer) | Melting Time (0.2 N NaOH, 60° C.) (sec): Protective Layer (sec) | Melting Time (0.2 N NaOH, 60° C.) (sec): Emulsion Layer (sec) |
|---|---|---|---|---|---|
| 9 | x | C-D | 193 | 48 | 48 |
| 15 (The present invention) | o | A | 84 | 437 | 130 |
| 16 (The present invention) | o | A | 77 | 523 | 139 |

As apparent from the above results, in the present invention, the film strength and the maximum density are correlated not with the melting time of the protective layer, but with the melting time of the emulsion layer. Furthermore, it can be seen from Table 6 that as the melting time of the protective layer is increased, the amount of gelatin eluted into the development processing liquid is reduced, which leads to a great improvement in scum properties.

While the invention has been described in detail and with reference to specific embodiments thereof, it will be apparent to one skilled in the art that various changes and modifications can be made therein without departing from the spirit and scope thereof.

What is claimed is:

1. A silver halide light-sensitive photographic material, comprising:

a support; and a plurality of layers on at least one side of the support wherein at least one of the layers is a light-sensitive silver halide emulsion layer, and further wherein a light-insensitive uppermost layer of the layers has a melting time greater than that of the light-sensitive silver halide emulsion layer, wherein the light-insensitive uppermost layer comprises gelatin hardened by a non-diffusible polymeric hardener.

2. The silver halide light-sensitive photographic material as claimed in claim 1, wherein the relation between the melting time of the uppermost layer (MTu) and that of the light-sensitive silver halide emulsion layer (MTs) represented by MTu/MTs ratio is in a range of more than 1 and less than 20.

3. The silver halide light-sensitive photographic material as claimed in claim 1, wherein the relation between the melting time of the uppermost layer (MTu) and that of the light-sensitive silver halide emulsion layer (MTs) represented by MTu/MTs ratio is in a range of more than 1 and less than 10.

4. The silver halide light-sensitive photographic material as claimed in claim 1, wherein the uppermost layer has a thickness of from about 0.5 to about 2.0 microns.

5. The silver halide light-sensitive photographic material as claimed in claim 1, wherein at least one of the light-sensitive silver halide emulsion layer is provided on both sides of the support and the uppermost layer is provided on the outside of the outermost silver halide emulsion layer existed on both sides of the support.

6. The silver halide light-sensitive photographic material as claimed in claim 1, wherein the plurality of layers contain non-diffusible polymeric hardeners.

7. The silver halide light-sensitive photographic material as claimed in claim 6, wherein the non-diffusible polymeric hardener has molecular weight of more than about 10,000 and at least one functional group reactive to gelatin to form cross-linking.

8. The silver halide light-sensitive photographic material as claimed in claim 6, wherein the non-diffusible polymeric hardener has a repeating unit of the formula (I):

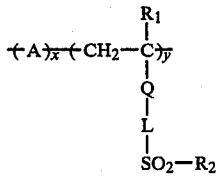

(I)

wherein A is a monomer unit prepared by copolymerizing copolymerizable ethylenically unsaturated monomers; $R_1$ is hydrogen or a lower alkyl group having 1 to 6 carbon atoms; Q is $—CO_2—$,

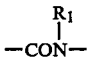

wherein $R_1$ is the same as defined above, or an arylene group having 6 to 10 carbon atoms; L is a divalent group having 3 to 15 carbon atoms and containing at least one linking group selected from the members consisting of $—CO_2—$ and

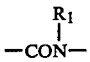

wherein $R_1$ is the same as defined above, or a divalent group having 1 to 12 carbon atoms and containing at least one linking group selected from the members consisting of —O—,

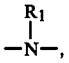

—CO—, —SO—, $—SO_2—$, $—SO_3—$,

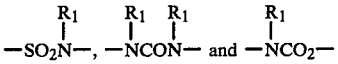

wherein $R_1$ is the same as defined above; $R_2$ is $—CH{=}CH_2$ or $—CH_2CH_2X$ wherein X is a group capable of being substituted with a nucleophilic group or a group capable of being released in the form of HX upon a base; and x and y each represents molar percent, x being between 0 and 99 and y being between 1 and 100.

9. The silver halide light-sensitive photographic material as claimed in claim 6, wherein the non-diffusible polymeric hardener has a repeating unit of the formula (II):

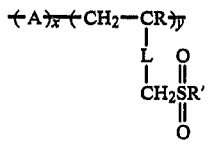

(II)

wherein A is a polymerized $\alpha,\beta$-ethylenically unsaturated addition polymerizable monomer or a mixture of such polymerizable monomers, x is a molar unit of from 10 to 95, and y is a molar unit of from 5 to 90, L is a linking group selected from the group consisting of alkylene, arylene, COZ and $COZR_3$, $R_3$ is selected from the group consisting of alkylene and arylene, Z ir O or NH, R is hydrogen or alkyl having 1 to 6 carbon atoms, and R' is $—CH=CHR_2$ or $—CH_2CH_2X$ where X is a leaving group which can be displaced by a nucleophile or can be eliminated in the form of HX upon treatment with base and $R_2$ is hydrogen, alkyl or aryl.

10. The silver halide light-sensitive photographic material as claimed in claim 6, wherein the non-diffusible polymeric hardener contains (i) 5 to 100 molar percent of a repeating unit of the general formula (III):

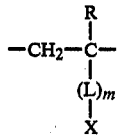

(III)

wherein R is a hydrogen atom or an alkyl group having 1 to 6 carbon atoms; L, if present, is a divalent linking group having 1 to 20 carbon atoms; X is an active carboxylic ester group; and m is 0 or 1; and optionally contains (ii) 0 to 95 molar percent of one or more other monomer unit "A".

11. The silver halide light-sensitive photographic material as claimed in claim 6, wherein the non-diffusible polymeric hardener has a repeating unit selected form the group consisting of:

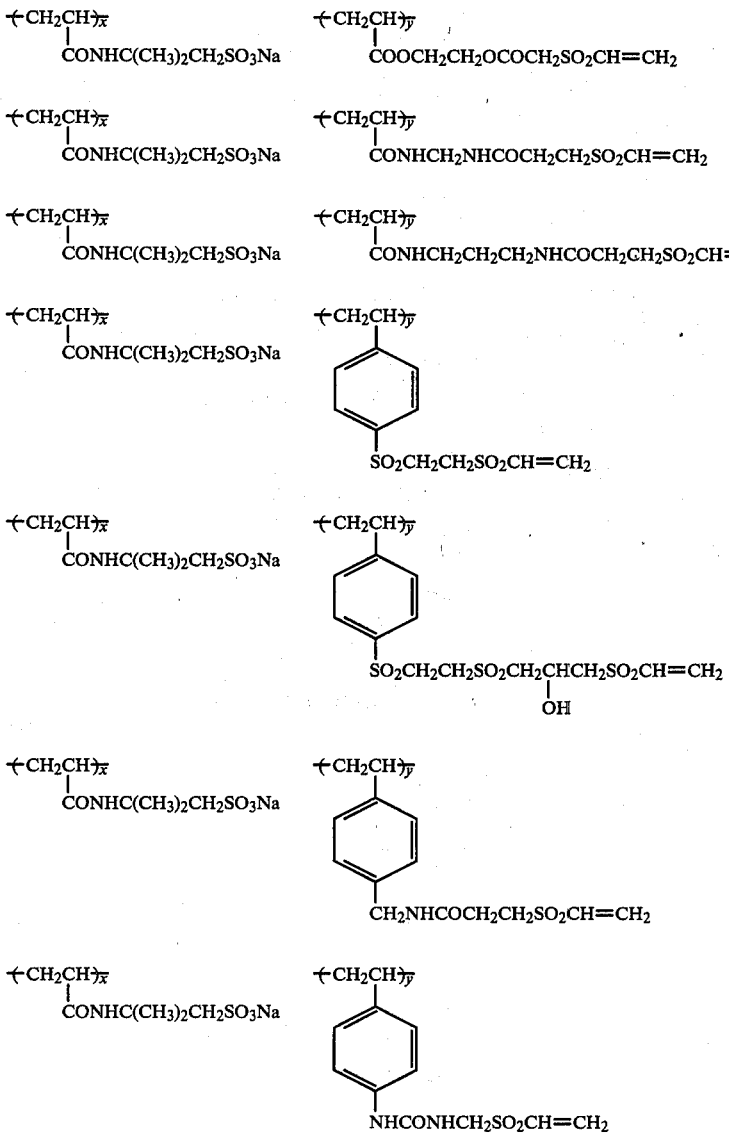

-continued

| | |
|---|---|
| $\leftarrow CH_2CH \rightarrow_x$ <br> $\vert$ <br> $CONHC(CH_3)_2CH_2SO_3Na$ | $\leftarrow CH_2CH \rightarrow_y$ <br> $\vert$ <br> $CONHCOCH_2CH_2SO_2CH{=}CH_2$ |
| $\leftarrow CH_2CH \rightarrow_x$ <br> $\vert$ <br> $CONHC(CH_3)_2CH_2SO_3Na$ | $\leftarrow CH_2CH \rightarrow_y$ <br> $\vert$ <br> $COOCH_2CH_2OCOCH_2SO_2CH_2CH_2Cl$ |
| $\leftarrow CH_2CH \rightarrow_x$ <br> $\vert$ <br> $CONHC(CH_3)_2CH_2SO_3Na$ | $\leftarrow CH_2CH \rightarrow_y$ <br> $\vert$ <br> $CONHCH_2NHCOCH_2CH_2SO_2CH_2CH_2Cl$ |
| $\leftarrow CH_2CH \rightarrow_x$ <br> $\vert$ <br> $CONHC(CH_3)_2CH_2SO_3Na$ | $\leftarrow CH_2CH \rightarrow_y$ <br> $\vert$ <br> $CONHCH_2NHCOCH_2CH_2SO_2CH_2CH_2Br$ |
| $\leftarrow CH_2CH \rightarrow_x$ <br> $\vert$ <br> $CONHC(CH_3)_2CH_2SO_3Na$ | $\leftarrow CH_2CH \rightarrow_y$ <br> 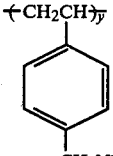 <br> $CH_2NHCOCH_2CH_2SO_2CH_2CH_2Cl$ |
| $\leftarrow CH_2CH \rightarrow_x$ <br> $\vert$ <br> $CONHC(CH_3)_2CH_2SO_3Na$ | $\leftarrow CH_2CH \rightarrow_y$ <br> 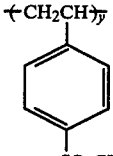 <br> $SO_2CH_2CH_2SO_2CH_2CH(OH)-CH_2SO_2CH_2CH_2Cl$ |
| $\leftarrow CH_2CH \rightarrow_x$ <br> $\vert$ <br> $CONHC(CH_3)_2CH_2SO_3Na$ | $\leftarrow CH_2CH \rightarrow_y$ <br> $\vert$ <br> $CONHCOCH_2CH_2SO_2CH_2CH_2Cl$ |
| $\leftarrow CH_2CH \rightarrow_x$ <br> $\vert$ <br> $COOM$ | $\leftarrow CH_2CH \rightarrow_y$ <br> $\vert$ <br> $CONHCH_2COCH_2CH_2SO_2CH_2CH_2Cl$ |
| $\leftarrow CH_2CH \rightarrow_x$ <br> $\vert$ <br> $COOM$ | $\leftarrow CH_2CH \rightarrow_y$ <br> $\vert$ <br> $CONHCH_2NHCOCH_2CH_2SO_2CH{=}CH_2$ |
| $\leftarrow CH_2CH \rightarrow_x$ <br> $\vert$ <br> $COOM$ | $\leftarrow CH_2CH \rightarrow_y$ <br> 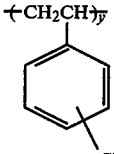 <br> $CH_2NHCOCH_2CH_2SO_2CH{=}CH_2$ |
| $\leftarrow CH_2CH \rightarrow_x$ <br> $\vert$ <br> $COOM$ | $\leftarrow CH_2CH \rightarrow_y$ <br> 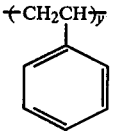 <br> $CH_2NHCOCH_2CH_2SO_2CH_2CH_2Cl$ |
| $\leftarrow CH_2CH \rightarrow_x$ <br> $\vert$ <br> $COOM$ | $\leftarrow CH_2CH \rightarrow_y$ <br> 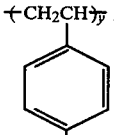 <br> $SO_2CH_2CH_2SO_2CH_2CH(OH)CH_2SO_2CH{=}CH_2$ |

-continued

| | |
|---|---|
| $\leftarrow CH_2CH \rightarrow_x$ <br> COOM | $\leftarrow CH_2CH \rightarrow_y$ <br> 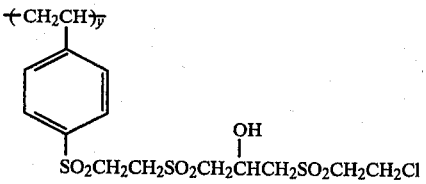 |
| $\leftarrow CH_2CH \rightarrow_x$ <br> COOM | $\leftarrow CH_2CH \rightarrow_y$ <br> $COOCH_2CH_2OCOCH_2SO_2CH{=}CH_2$ |
| and | |
| $\leftarrow CH_2CH \rightarrow_x$ <br> COOM | $\leftarrow CH_2CH \rightarrow_y$ <br> $COOCH_2CH_2OCOCH_2SO_2CH_2{-}CH_2Cl$ |

wherein M is a hydrogen atom, a sodium atom or a potassium atom, and x and y represent moler percent x being from 0 to 99, and y being from 1 to 100.

12. The silver halide light-sensitive photographic material as claimed in claim 6, wherein the non-diffusible polymeric hardener is a member selected from the group consisting of [2-(3-vinylsulfonyl)propionyloxy]ethyl ethyl acrylate/sodium acrylamido-2-methylpropanesulfonate copolymer, 2-[3-(chloroethylsulfonyl)-propionyloxy]ethyl acrylate/sodium acrylamido-2-methylpropanesulfonate copolymer, [3-(chloroethylsulfonyl)propionyl]aminomethylstyrene/sodium acrylamido-2-methylpropanesulfonate copolymer and 1-{[2-(4-vinylbenzenesulfonyl)ethyl]sulfonyl}-3-chloroethylsulfonyl-2-propanol/sodium acrylate copolymer.

* * * * *